United States Patent [19]

Ichikawa et al.

[11] 4,401,849

[45] Aug. 30, 1983

[54] SPEECH DETECTING METHOD

[75] Inventors: Akira Ichikawa, Musashino; Nobuo Hataoka, Hachiouji; Yoshiaki Kitazume, Sayama; Eiji Ohira, Hachiouji, all of Japan

[73] Assignee: Hitachi, Ltd., Tokyo, Japan

[21] Appl. No.: 227,677

[22] Filed: Jan. 23, 1981

[30] Foreign Application Priority Data

Jan. 23, 1980 [JP] Japan ..... 55-5690

[51] Int. Cl.[3] ..... G10L 1/00

[52] U.S. Cl. ..... 179/1 SC; 179/1 VC

[58] Field of Search ..... 179/1 SC, 1 SA, 1 SB, 179/1 SD, 1 HF, 15.55 R, 15.55 T, 1 VC, 1 VL; 455/212, 218, 221, 222, 245; 370/81, 118

[56] References Cited

U.S. PATENT DOCUMENTS

| | | | |
|---|---|---|---|
| 4,001,505 | 1/1977 | Araseki et al. | 179/1 SC |
| 4,044,309 | 8/1977 | Smith | 179/1 SC |
| 4,052,568 | 8/1977 | Jankowski | 179/1 SC |
| 4,074,069 | 2/1978 | Tokura et al. | 179/1 SC |

*Primary Examiner*—Emanuel S. Kemeny

*Attorney, Agent, or Firm*—Antonelli, Terry & Wands

[57] ABSTRACT

Speech signal presence is decided if total signal power is above a first threshold, and if either low or high frequency components exceed thresholds as a large fraction of the total power. Total power is calculated as the zero-order auto-correlation coefficient, and fractional power of frequency components is calculated as the first-order partial auto-correlation coefficient.

6 Claims, 3 Drawing Figures

SPEECH DETECTING METHOD

BACKGROUND OF THE INVENTION

1. Field of the Invention

This invention relates to a speech detecting method for detecting the interval of an input speech in a speech recognition system.

2. Description of the Prior Art

Heretofore, for detecting the interval of an input speech, the power information of the input speech has been principally employed, with the zero-crossing information of the input speech, also being empirically employed. The method employing the zero-crossing information utilizes the fact that the number of times at which the zero axis is crossed is larger in unvoiced consonants having substantial high-frequency components greater than in voiced phones and noise with substantial low-frequency components. However, when the distribution of the number of times of zero-crossing of the unvoiced consonants, the voiced phones and noise is investigated, it is found that the number of times coincide with each other in many parts, and so it is difficult to achieve a high-precision classification by resorting to the number of times of the zero-crossing.

According to the prior-art method described above, it has been difficult to detect, for example, unvoiced consonants (ex "s" and "h") at the starting point and end point of input speech. Therefore, a threshold value has been lowered in order to raise the detection sensitivity. As a result, a problem occurs that a room noise, for example, is deemed input speech and is erroneously detected. Especially in case where the speech is received through a conventional telephone, ambient noise (this includes the room noise etc.) is liable to mix because the telephone has no directivity. It is an important subject to distinguish between input speech and ambient noise.

SUMMARY OF THE INVENTION

This invention has an object of providing a speech detecting method which employs quantities having unequal values as a function of input speech and ambient noise, to solve the problem described above.

In order to accomplish the object, with note taken of the fact that the difference of the general shapes of the frequency spectra of an unvoiced consonant and ambient noise in an input speech appears in the value of the first-order partial auto-correlation coefficient, this invention consists in employing the first-order partial auto-correlation coefficient and the power information described before (the zero-order auto-correlation coefficient) as featuring quantities. More specifically, the first-order partial auto-correlation coefficient and the zero-order auto-correlation coefficient which are extracted from an input speech are compared with predetermined threshold values, thereby to distinguish between the true input speech and ambient noise.

DESCRIPTION OF THE PREFERRED EMBODIMENTS

Figure 1:
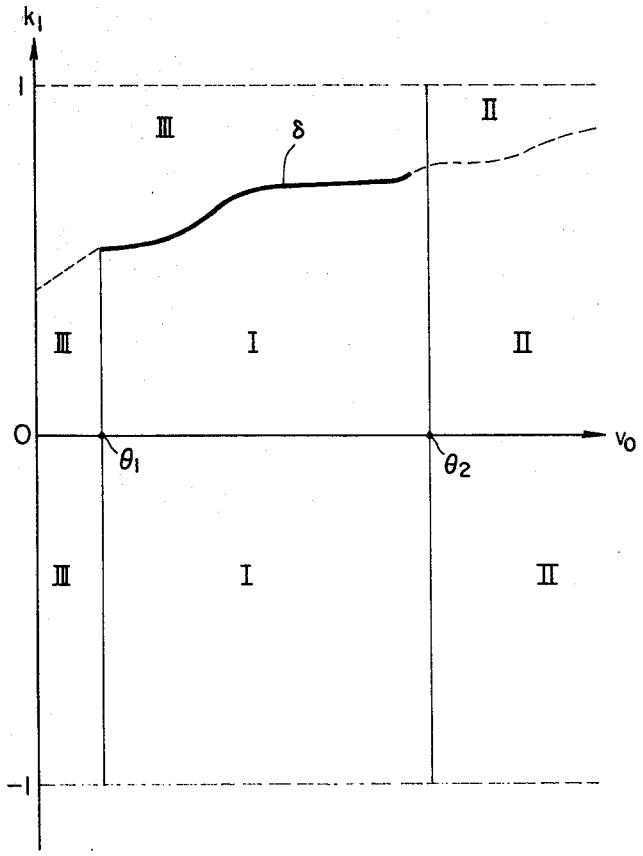
FIG. 1 is a diagram illustrating the first order auto-correlation coefficient $k_1$ as a function the zero order auto-correlation coefficient $v_0$ for an input speech.

As is well known, ordinary unvoiced consonants have frequency spectra exhibiting the characteristics of high-frequency region emphasis in which components in a high-frequency region of 3–10 kHz are comparatively great to other frequency components.

On the other hand, ordinary ambient noise has low power and the the characteristic of low-frequency region emphasis which have gradients on the order of −9 dB/oct for increasing frequency (the power attenuates −9 dB each time the frequency is doubled).

Voiced phones such as vowels have the frequency characteristic of low-frequency region emphasis similar to the frequency characteristic of ordinary ambient noise, but they have greater power than the ambient noise in the low frequency region.

When the difference of the frequency characteristics are utilized, the detection of a speech interval is permitted by classifying speeches as follows:

(i) If speech has low-frequency region emphasis and has at least a fixed power $\theta_2$, it is a voiced phone.

(ii) If speech has low-frequency region emphasis and its power is below the fixed power $\theta_2$, it is ambient noise.

(iii) If speech has high-frequency region emphasis, it is an unvoiced consonant irrespective of the magnitude of power.

Here, in case where a speech having an extremely low power in spite of exhibiting the characteristic of high-frequency region emphasis has been detected, there is the possibility that a speech not being an unvoiced consonant would have mixed on account of a calculative error at the detection of the speech interval, etc. Therefore, if the power is below $\theta_1(\theta_1<\theta_2)$, the detected speech needs to be excluded.

The principle according to which the aforecited classification is made by the use of the first-order partial auto-correlation coefficient and the zero-order auto-correlation coefficient (power information) is described as follows.

For the sake of brevity, in the following description, input speech will be modeled into a signal having a single frequency.

The first-order partial auto-correlation coefficient ($k_1$) is evaluated by Equation (1) from the zero-order auto-correlation coefficient ($v_0$) and the first-order auto-correlation coefficient ($v_1$):

$$k_1=v_1/v_0 \tag{1}$$

The angular frequency $\omega$ into which the sampling frequency $f_s$ of the input speech is normalized in correspondence with $2\pi$ is considered, and the input speech is given as Equation (2) by way of example:

$$f(t)=a\sin(\omega t+\phi) \tag{2}$$

At this time, $v_0$ and $v_1$ become as follows:

$$v_0=a^2/2 \tag{3}$$

$$v_1=a^2/2\cdot\cos\omega T_s \tag{4}$$

From Equations (3) and (4), $$k_1 = \cos \omega T_s \quad (5)$$

where $T_s = 1/f_s$

The folding frequency $f_R$ is ½ of the sampling frequency $f_s$. That is, $$f_R = f_S/2 = 2\pi/2 = \pi$$

is caused to correspond to the frequency bandwidth (BW) of the input speech, (I) for $\pi/2 < BW \leqq \pi$ (on the high-frequency side), $-1 \leqq k_1 < 0$ (II) for $0 \leqq BW \leqq \pi/2$ (on the low-frequency side), $0 \leqq k_1 \leqq 1$ The quantity $v_0$ corresponds to the power and is always positive.

From the above analysis, it is understood that the quantity $k_1$ of a speech signal whose high-frequency component is intense comes close to (−1), whereas $k_1$ of a speech signal whose low-frequency component is intense comes close to (+1).

It can be experimentally verified that even where the band is considerably limited as in, for example, the telephone, $k_1 < 0.7$ holds for the unvoiced consonants "s" and "h", whereas $k_1 > 0.7$ holds for the ambient noise.

Accordingly, by exploiting the characteristics of $k_1$ as described above and the fact that ordinarily the signal component has a greater power than the noise component, input speeches can be classified into the classification (i)–(iii) supra.

The detections of the start and end of the input speech interval, based on the classifications (i)–(iii) supra may be made as follows by way of example:

$\theta_1$, $\theta_2$: predetermined threshold values concerning power ($\theta_2 > \theta_1$), $\delta$: a predetermined threshold value concerning the first-order partial auto-correlation coefficient (in general, it is set at values in dependence on the magnitude of power), $T_sH$, $T_I$, $T_E$: predetermined threshold values concerning time.

(I) $v_0 \geqq \theta_2$ (II) $v_0 \geqq \theta_1$ ($\theta_2 > \theta_1$) and $k_1 \leqq \delta$ If a state satisfying either condition I or condition II holds for at least the period of time $T_sH$ continuously or intermittently, it is determined that an input speech interval has started. If a state satisfying neither of condition (1) and condition (2) holds for at least the period of time $T_E$ continuously or intermittently, it is determined that the input speech interval has ended. Thus, the input speech interval is detected.

In the case where the state holds intermittently or off-and-on, the "off" situation is regarded as having been nonexistent if it continues for a period of time shorter than $T_I$.

FIG. 1 illustrates setting examples of the threshold values $\theta_1$, $\theta_2$ and $\delta$ for determining the type of speech signals on the basis of the values of $v_0$ and $k_1$, and regions in which the respective speech signals and ambient noise are detected in accordance with the threshold values.

In FIG. 1, a region I corresponds to the classification (iii) and indicates that the input speech is an unvoiced consonant, while region II corresponds to the classification (i) and indicates that the input speech is a voiced phone. A region III corresponds to the classification (ii) and indicates that the input speech is ambient noise including the room noise and random noise due to the calculative error at the detection of a speech interval, etc. It has been experimentally verified that ordinarily $\delta$ varies as a function of $v_0$ such that $\delta = \delta(v_0)$. In case of some types of input speech, however, it may well be set at a fixed value as, for example, $\delta = 0.7$.

Actual input speech is not a single frequency, but instead has a waveform in which a plurality of frequency components are present. Therefore, the sum of the power values and the first-order auto-correlation coefficient values of the respective frequency components may be used as the coefficients $v_0$ and $v_1$ respectively so as to evaluate the first-order partial auto-correlation coefficient from the relationship $k_1 = v_1/v_0$.

More specifically, assuming that the frequency band of the input speech is $f_o$–$f_c$ (Hz), the waveform of the actual input speech signal is approximately expressed by the following equation:

$$f(t) = \sum_{n=1}^{N} a_n \sin(n\,\omega_o\,t + \phi_n) \quad (6)$$

where $\omega_o = 2\pi f_o$, and N: number of the frequency components.

From this equation, $v_0$ and $v_1$ in Equations (3) and (4) become:

$$v_o = \frac{1}{T_F} \int_0^{T_F} f(t)^2\,dt \ (T_F\text{: length of a frame}) = \tfrac{1}{2} \sum_{n=1}^{N} a_n^2 \quad (7)$$

$$v_1 = \frac{1}{T_F} \int_0^{T_F} f(t) \cdot f(t + T_S)\,dt \ (T_S\text{: sampling period}) = \tfrac{1}{2} \sum_{n=1}^{N} a_n^2 \cos n\,\omega_o\,T_S \quad (8)$$

Accordingly, $k_1$ is calculated as:

$$k_1 = \frac{v_1}{v_o} = \frac{\sum_{n=1}^{N} a_n^2 \cos n\,\omega_o\,T}{\sum_{n=1}^{N} a_n^2} \quad (9)$$

In the case of telephone speech, the frequency band usually ranges from 150–4,000 Hz and hence, the sampling frequency may be set at $f_S = 8{,}000$ Hz. Accordingly, the sampling period becomes $T_S = 1/f_S = 125$ μs.

The length of one frame should be set at an appropriate value. It should be short for a phone of abrupt variation such as an explosion. It should be long for a phone of slow variation such as conversation with little intonation. Usually, it is set in the range of 5 ms–20 ms.

The invention is described hereinafter in detail with reference to a specific embodiment.

Figure 2:
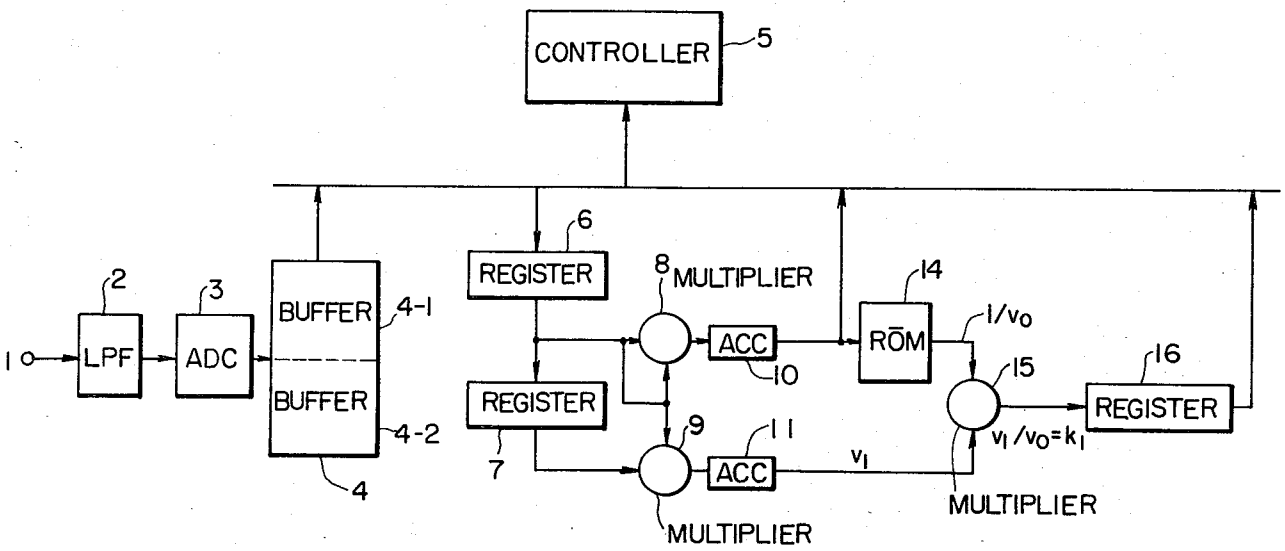
FIG. 2 is a circuit block diagram showing an embodiment of this invention.

FIG. 2 is a circuit block diagram showing an embodiment of the invention.

An input speech signal 1 passes through a low-pass filter 2 for preventing reflected noise and is converted into a digital signal by an analog-to-digital converter 3. The digital signal is applied to an input buffer memory 4. The input buffer memory 4 is of a double buffer construction which consists of two memory areas 4-1 and 4-2. Each memory area stores data corresponding to one frame period. While data are being applied to one of the areas (for example, 4-2), predetermined processing is executed for data applied in the other area (for example, 4-1).

A control signal generated in a controller 5, controls the transferred data within the memory area 4-1 to a register 6.

At the the time of transfer of data from the buffer area 4-1 the data which were applied to the register 6 one sampling period earlier are transferred to a register 7.

The data (denoted by $D_6$) stored in the register 6 and the data (denoted by $D_7$) stored in the register 7 are respectively applied to multipliers 8 and 9. A multiplied result ($D_6 \times D_6$) produced by the multiplier 8 is added to the content of an accumulator (ACC) 10. At the same time, a multiplied result ($D_6 \times D_6$) produced by the multiplier 9 is added to the content of an accumulator (ACC) 11.

When the above calculations have been completed for all the data stored within the memory area 4-1, the calculations of the integrals in Equations (7) and (8) is executed in the accumulators 10 and 11 respectively. In the accumulator 10, the quantity $T_F$ times of the zero-order auto-correlation coefficient $v_0$ power information for the data ($v_0 \times T_F$) is obtained. In the accumulator 11, the quantity $T_F$ times the first-order correlation coefficient $v_1$ ($v_1 \times T_F$) is obtained. Since $T_F$ is a constant, it is unnecessary to divide the obtained values by $T_F$ when the threshold values $\theta_1$ and $\theta_2$ are multiplied by $T_F$ in advance. As seen from Equation (9), $k_1$ remains unchanged even when terms $T_F$ are included in the denominator and the numerator. Hereinafter, the $v_0$ or $v_1$ multiplied by $T_F$ will be considered as $v_0$ or $v_1$ in the explanation.

Output data from the accumulator 10 are stored in a memory within the controller 5, and simultaneously serve as a read-out address for a ROM 14. The output is converted into its inverse number $1/v_0$ in the ROM 14, and functions as a multiplier in multiplier unit 15. Output data from the accumulator 11 function as a multiplicand in the multiplier unit 15. In the multiplier unit 15, the output $v_1$ is multiplied by the value $1/v_0$ to obtain the first-order partial auto-correlation coefficient $k_1$, which is stored in a register 16 and is thereafter stored in the memory within the controller 5.

Subsequently, from data in the next frame period, the coefficients $v_0$ and $k_1$ for this frame period are calculated via the same process as described above. They are stored in the memory within the controller 5.

Thereafter, in the same manner, one set of the coefficients $v_0$ and $k_1$ is calculated for every frame period, and such sets are successively stored in the memory within the controller 5. The control signals required for the calculations described above are all supplied from the controller 5. For the sake of brevity, however, only the flow of the data is illustrated in FIG. 2 and the control signals are omitted from the illustration.

Now, there will be described a concrete example of procedures for detecting the start and end of an input speech interval by the use of the coefficients $v_0$ and $k_1$ evaluated for the respective frame periods.

(A) Start of Speech Interval:

$$v_0 \geqq \theta_2 \quad ①$$

$$v_0 \geqq \theta_1 (\theta_2 > \theta_1) \text{ and } k_1 \leqq 0.7 \quad ②$$

If frames satisfying Item ① or ② continue for at least $T_S = 50$ msec continuously, it is decided that an input speech interval has started.

However, even when the state in which the condition is continuously satisfied is interrupted, the interruption is regarded as having been nonexistent if the interrupted frame or frames is/are shorter than $T_I = 30$ msec.

(B) End of Speech Interval:

$$v_0 < \theta_4 \text{ and } k_1 > 0.7 \quad ③$$

$$v_0 < \theta_3 \quad ④$$

If frames satisfying Item ③ or ④ continue for at least $T_F = 300$ msec it is decided that the input speech interval has ended.

However, even when the state in which the condition is continuously satisfied is interrupted, the interruption is regarded as having been nonexistent if the interrupted frame or frames is/are shorter than $T_I = 30$ msec.

$\theta_3$ and $\theta_4$ in the case (B) may be made equal to $\theta_1$ and $\theta_2$ in the case (A) respectively, or may be made $\theta_3 \simeq \theta_1$ and $\theta_4 \simeq \theta_2$. The threshold value $\delta$ concerning the coefficient $k_1$ has been made 0.7 because this value has been experimentally verified to be the optimum threshold value for deciding whether the input speeches to which the embodiment is directed are unvoiced consonants or ambient noise.

The decisions centering on the comparing operations are executed by means of a special-purpose processor within the controller 5 in FIG. 1, which may be a programmed microprocessor, or the like.

It should be understood that changes of the threshold values concerning the coefficients $v_0$ and $k_1$, the time (the number of frames), etc., changes of the decision procedures, and addition of a new decision criterion can be made as desired according to changes in environmental conditions.

Further, after having detected the speech interval in accordance with this invention, a recognition processing, in which the detected speech is matched with a standard pattern, can be executed by the microprocessor within the controller 5 by utilizing, for example, the dynamic programming method.

Figure 3:
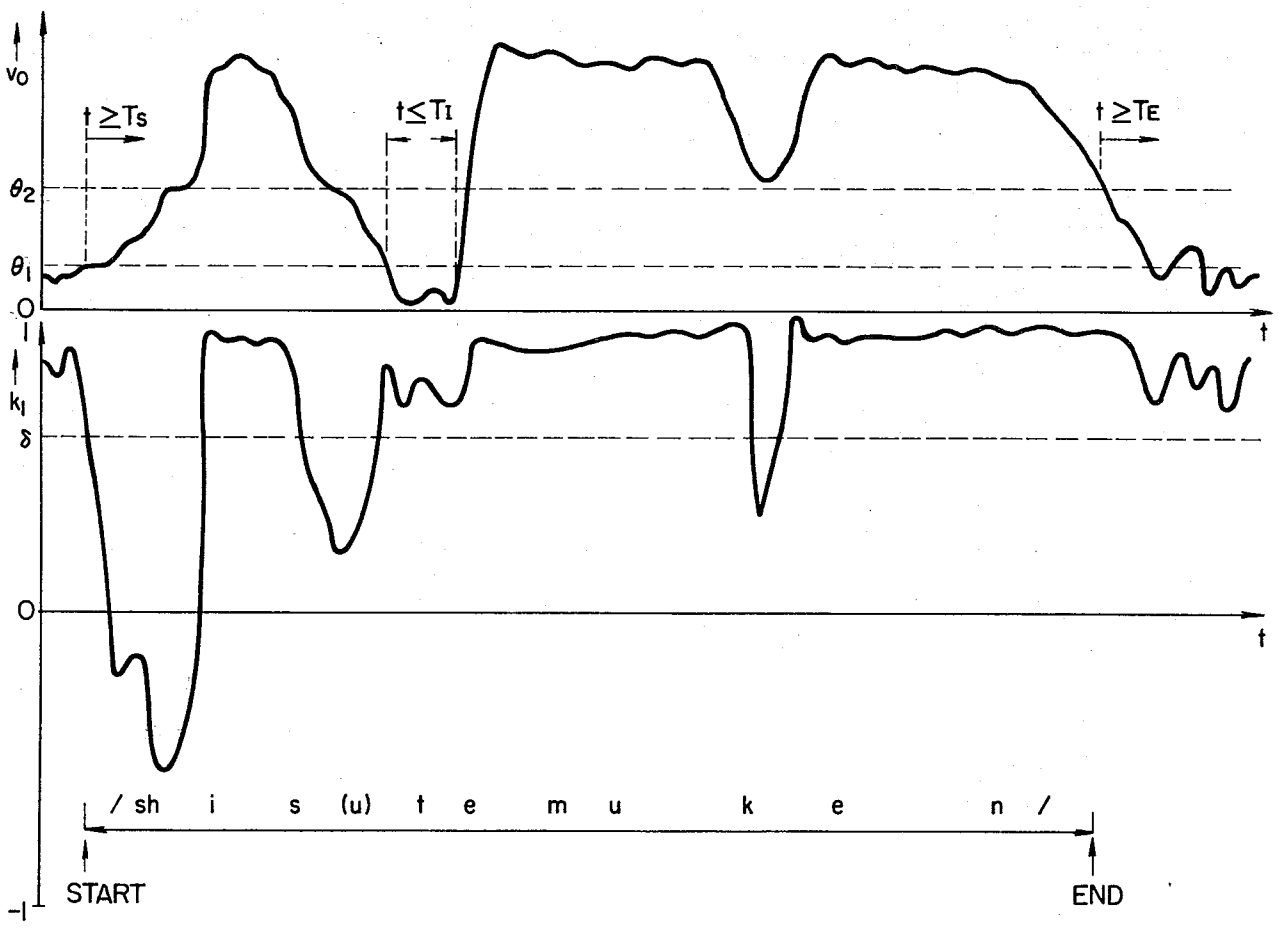
FIG. 3 is a diagram showing experimental data at the time when a speech interval was detected in accordance with this invention.

FIG. 3 is a diagram illustrating the time variation of the coefficients $v_0$ and $k_1$ of an input speech, and the fact that the starting point and end point of the speech can be detected by setting the threshold values concerning $v_0$ as $\theta_1 = \theta_3$ and $\theta_2 = \theta_4$.

According to FIG. 3, it is understood that with the prior-art method employing only $v_0$, when the predetermined value is made $\theta_2$, the detection of /sh/ is impossible because $\theta_1 < v_0 < \theta_2$ holds in a part corresponding to /sh/ being the starting point of the speech, whereas when the predetermined value is lowered to $\theta_1$ in order to render /sh/ detectible, it is feared to be confused with ambient noise.

In contrast, when the coefficient $k_1$ is jointly used in accordance with this invention, with reference to the consonant blend sh, $k_1 \leqq \delta$ holds and therefore the condition of Item ② in the case (A) is satisfied. Moreover, the duration of the input speech satisfies the condition of Item ① or ② of the case (A) by exceeding the predetermined threshold value $T_S$, so that the starting point is correctly detected.

In an intermediate part corresponding to the sound te for, $v_0 < \theta_1$ and $k_1 > \delta$ hold, and accordingly, both the items ③ and ④ in the case (B) are satisfied. Since, however, the duration of such state is shorter than the predetermined threshold value $T_I$, this state is processed as a temporary interruption, and not as the end of the speech.

When the end point of the speech has been reached, both the items (3) and (4) in the case (B) are fulfilled, and the duration of this state exceeds the predetermined threshold value $T_E$, so that the end point is correctly detected.

The letter u is unvocalized and is consequently omitted.

The detection of the speech interval is made with reference to the points of time at which the starting point and the end point have been decided upon satisfying the cases (A) and (B) first, respectively.

In case of applying this invention to the processings of the speech recognition, at the point of time when the condition (1) or (2) in (A) has been met, a recognizing operation is initiated by deeming the input a candidate for the start point of the speech, and if the continuing state of the condition has ended in a period shorter than $T_S$, processings for recognition having been made till then may be nullified. Thus, the inconvenience of a detection lag can be avoided.

As set forth above, according to this invention, even unvoiced consonants at the starting point and end point of an input speech can be correctly detected without being confused with ambient noise. Therefore, the detection precision of a speech interval can be remarkably enhanced, which brings forth a great practical value.

We claim:

1. A speech detecting method comprising the first step of extracting a zero-order auto-correlation coefficient and a first-order partial auto-correlation coefficient from every fixed extraction interval of an input signal, and the second step of determining whether or not said input signal is a speech signal depending upon whether or not either a first state under which said zero-order auto-correlation coefficient is greater than a first threshold value or a second state under which said zero-order auto-correlation coefficient is greater than a second threshold value and wherein said first-order partial auto-correlation coefficient is smaller than a third threshold value continuously or intermittently at least for a predetermined number of the extraction intervals.

2. A speech detecting method as defined in claim 1, wherein a starting point of said speech signal is decided when at least one of said first state and said second state holds continuously or intermittently at least for a predetermined number of the extraction intervals.

3. A speech detecting method as defined in claim 1, wherein an end point of said speech signal is decided when a state under which neither said first state nor said second state has continued continuously or intermittently at least for a predetermined number of the extraction intervals.

4. A speech detecting method for determining if a signal is a speech signal comprising extracting a zero-order auto-correlation coefficient and a first-order partial auto-correlation coefficient from every fixed extraction interval of an input signal, and determining if said input signal is a speech signal by analyzing the input signal for the presence of either a first state in which said zero-order auto-correlation coefficient is greater than a first threshold value or a second state in which said zero-order auto-correlation coefficient is greater than a second threshold value and in which said first-order partial auto-correlation coefficient is smaller than a third threshold value continuously or intermittently at least for a predetermined number of the extraction intervals.

5. A speech detecting method as defined in claim 4, wherein a starting point of said speech signal is detected when at least one of said first state and said second state has continued either continuously or intermittently at least for a predetermined number of the extraction intervals.

6. A speech detecting method as defined in claim 4, wherein an end point of said speech signal is detected when neither said first state nor said second state has continued continuously or intermittently at least for a predetermined number of the extraction intervals.

* * * * *